United States Patent [19]

Gustafson

[11] Patent Number: 4,522,401

[45] Date of Patent: Jun. 11, 1985

[54] MANIPULATABLE PUZZLE TOY

[76] Inventor: William O. Gustafson, 2712 E. Robinson Ave., Fresno, Calif. 93726

[21] Appl. No.: 299,738

[22] Filed: Sep. 8, 1981

[51] Int. Cl.[3] ..... A63F 9/08

[52] U.S. Cl. ..... 273/153 S

[58] Field of Search ..... 273/153 S, 155

[56] References Cited

U.S. PATENT DOCUMENTS

| | | | |
|---|---|---|---|
| 507,215 | 10/1893 | Churchill | 273/153 S |
| 1,085,994 | 2/1914 | Patterson | 273/153 S |
| 3,081,089 | 3/1963 | Gustafson | 273/153 S X |

FOREIGN PATENT DOCUMENTS

| | | | |
|---|---|---|---|
| WO81/01638 | 6/1981 | PCT Int'l Appl. | 273/153 S |

*Primary Examiner*—Anton O. Oechsle

[57] ABSTRACT

A puzzle having elements which are rotatable on a spherical core in groupings of eight in increments of forty-five degrees along any one of three mutually perpendicular zones, the puzzle including a spherical core; eight tongued-on-each-edge equilateral triangular tiles of spherical curvature whose sides are slightly less than forty-five degrees in length and which are fixedly bonded to the core at the vertices of an inscribed cube; eighteen grooved-on-each-edge equilateral quadrilateral tiles of spherical curvature whose sides are the same length as the triangular tiles, the quadrilateral tiles movable about the core in zonal groupings of eight but held to the core by the tongues of the triangular tiles projecting into the grooves of the quadrilateral tiles.

2 Claims, 7 Drawing Figures

MANIPULATABLE PUZZLE TOY

The present invention relates to a manipulable puzzle toy having a plurality of variegated parts which are movable relative to one another to form various configurations. It is a known object of puzzles to employ a plurality of parts adopted for connection or disconnection or, as in this present case, for relative movement in a predetermined and possible baffling manner, sequence, or ordered arrangement. Puzzles of this sort are a never ending source of amusement challenging the user's ingenuity, patience, and insight to effect a solution. It is to this type of puzzle that the manipulable puzzle toy of the present invention relates.

Accordingly it is an object of the present invention to provide a puzzle having a plurality of variegated parts movable relative to one another to form various patterns.

Another object is to provide a device which is in the form of a sphere having movable sections.

Another object is to provide a toy which is economical to manufacture and assemble into a saleable item.

These, together with other objects, will become more fully apparent upon reference to the following description.

Figure 2:
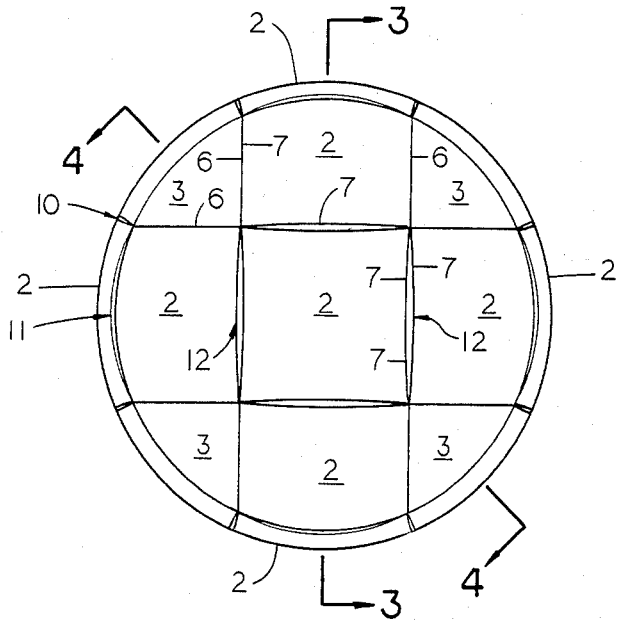
FIG. 2 is a full-faced view of FIG. 1 shown full scale.

Referring more particularly to the accompanying drawings, the puzzle of the present invention is constructed from three different parts. They are:

(1) An inner core 1 of substantially smooth outer surface 4 of constant radius on which the other parts are placed. These other parts are so placed that the outer surface 4 is divided into three (3) mutually perpendicular zones or closed loop tracks 21 each centered about three (3) mutually perpendicular great circles 11. The boundaries 20 of these zones form eight (8) triangular regions 17. The zones are 45 degrees wide.

(2) Eight (8) fixed tongued 8 spherical equilateral triangular tiles 3 whose convex surface 16 substantially conforms to the outer surface 4 of the core and are bonded using a suitable cement to the triangular regions 17 defined by the zonal boundaries 20 of the core surface. These triangular tiles are tongued on all three edges 8. The edge faces 15 of these fixed triangular tiles align with a radius of the sphere 5. The edges 6 of these fixed triangular tiles partially define the zonal boundaries.

Figure 6:
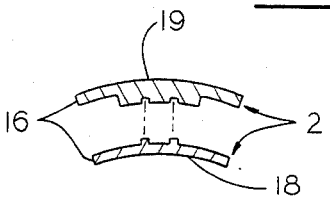
FIG. 6 is a cross-section of one of the grooved quadrilateral tiles but shown in two parts for purposes of faciliting manufacture and assembly shown full scale.
Figure 7:
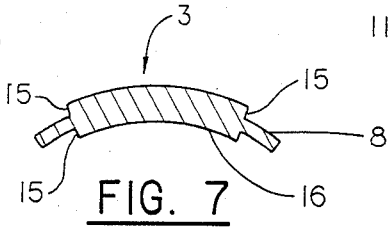
FIG. 7 is a cross section of one of the tongued triangular tiles taken from a vertex to the mid-point of the opposite side shown full scale.

(3) Eighteen (18) grooved spherical movable equilateral quadrilateral tiles 2 whose sides 7 are substantially of the same length as the sides 6 of the triangular tiles 3. This length should approximate one-eighth of the circumference of a small circle or zone boundary 20 located 22.5 degrees from a great circle 11. These quadrilateral tiles are grooved 9 on all four edges. It should be noted that where a triangular tile edge 6 adjoins a quadrilateral tile edge 7 there is a good fit but where a quadrilateral tile edge 7 adjoins another quadrilateral tile edge 7 there is a small gap which becomes 3.6 degrees wide at the center of the quadrilateral tile edge. This gap occurs because 45 degrees 13 minus 41.4 degrees 14 equals 3.6 degrees. In other words the circumference of the small circle or zone boundary 20 is 0.92 times (cosine 22.5 degrees) the circumference of the great circle 11. These quadrilateral tiles 2 are of substantially the same thickness 22 as the triangular tiles 3. The edges of the quadrilateral tiles 2 align with a radius 5 of a sphere. FIG. 6 shows a rectangular tile in two parts for purposes of ease of manufacture and assembly.

The tongues 8 of the fixed triangular tiles 3 project into the grooves 9 of the movable quadrilateral tiles 2 so that the quadrilateral tiles 2 are conformed to the core surface 4. However, those quadrilateral tiles 2 can move along any of three (3) mutually perpendicular zones 21 in preferred increments of 45 degrees or one tile length.

OPERATION

Figure 1:
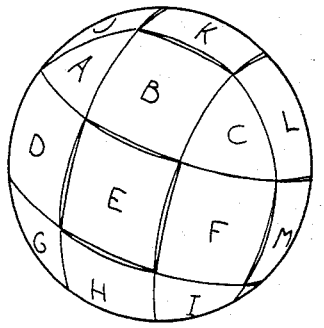
FIG. 1 shows an oblique view of the fully assembled sphere in a reduced scale showing a possible marking pattern.
Figure 3:
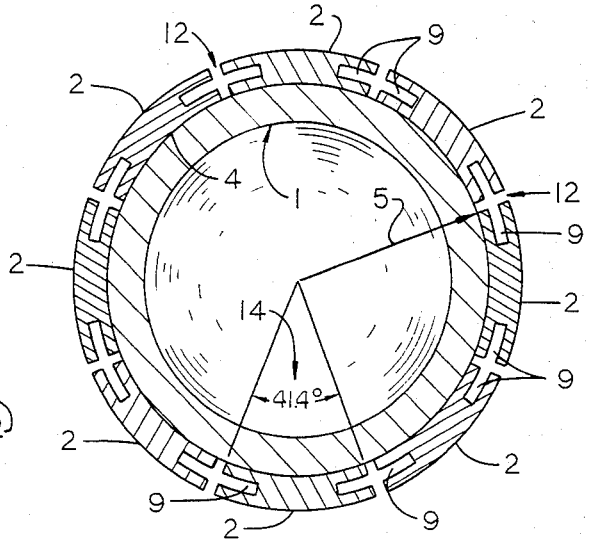
FIG. 3 is a transverse section of FIG. 2 taken on line 3—3 shown full scale.
Figure 4:
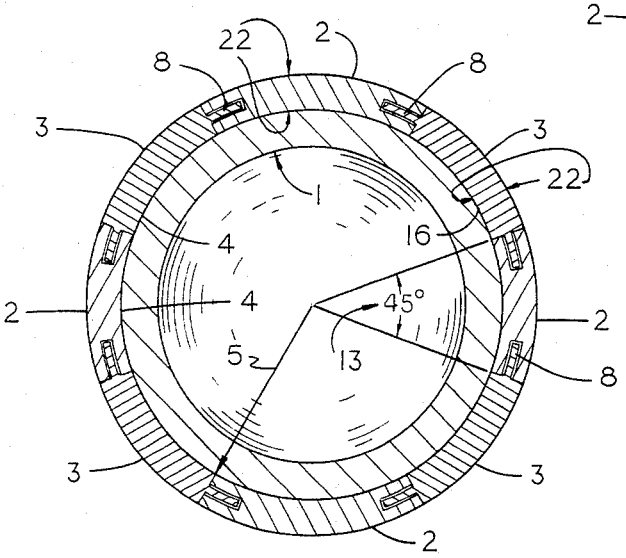
FIG. 4 is a transverse section of FIG. 2 taken on line 4—4 shown full scale.
Figure 5:
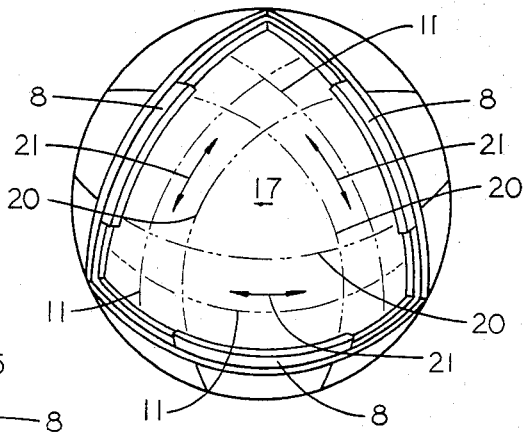
FIG. 5 is a direct view of a partially assembled toy puzzle shown full scale.

FIG. 1 shows a way of marking the outer surface of the tiles. This is just for purposes of discussion. Segments A,B,C,D,E,F,G,H, and I could be colored blue while segments J,K,L,M . . . (a total of eight quadrilaterals) could be colored white and the remaining nine tiles (five quadrilaterals and four triangles) could be colored red. Triangles A,C,G, and I would never move and likewise there would be four red triangles on the hidden side which would remain fixed. This color arrangement could be completely scrambled after a few rotations of the quadrilaterals. The rotations of this puzzle is most easily accomplished by the operator when using both hands. Referring to FIG. 1 the sphere is grasped in the left hand with the thumb on the tile M and the index finger on the tile D. Then the right hand grasps some of the members in the zonal alignment of tiles H,E,B,K . . . and rotates this alignment in either direction through any multiple of 45 degrees. One would then change the sphere in the left hand so as to rotate a different zonal grouping of tiles and so forth. This process could be continued indefinitely to produce a bewildering arrangement of tiles. The operator would then have the task of trying to achieve some desired ordered arrangement of tiles. An interesting feature of this puzzle can be understood by considering tile E in FIG. 1. It can be rotated to position K, then to position M, then back to its initial position; except now the "E" opens downward. The E tile has been rotated 90 degrees. In other words each of the 18 quadrilateral tiles can not only occupy any one 18 different positions, but may also have any of four different orientations. Such changes form the basis for excellent puzzle possibilities.

ASSEMBLY

This puzzle may be assembled by first bonding seven (7) triangular tiles in proper position. One such position is the triangular region 17 formed by the boundaries of the zones 20. Then twelve (12) quadrilateral tiles could be slipped into place. Then six (6) of the bottom pieces 18 of the quadrilateral tiles shown in FIG. 6 could be slipped into place. The final eighth triangular tile could then be cemented into its fixed position. Then the top part 19 of the last six (6) quadrilateral tiles shown in FIG. 6 could be mated to the bottom parts of the quadrilateral tiles with a suitable cement. An alternative method of assembly would be to make the core into two identical hemispheres and after the triangular tiles and the quadrilateral tiles are properly attached, the two hemispheres could then be bonded together.

PRIOR ART STATEMENT

Your petitioner believes that this invention although based on the prior art of tongue-in-groove confinement and movement is a new and useful improvement on that prior art. This is because prior art is hereby extended by the movement of zonally aligned quadrilaterals along any of three mutually perpendicular zones in increments of 45 degrees (or one tile length) and produces an overall new and unique device of surprising movement and symmetry. This invention is not obvious but can only be arrived at by thoughtful adherence to the true principles of spherical geometry and trigonometry.

Therefore your petitioner pleads that Letters Patent may be granted based on the following claims.

I claim:

1. A manipulable toy puzzle having elements rotatable about three mutually perpendicular bands, the puzzle comprising:

A. A core of substantially smooth outer surface and divisioned by three mutually perpendicular equitorial zonal bands each band slightly less than forty-five degrees wide, B. Eighteen (18) variegated movable grooved equilateral quadrilateral tiles of substantially spherical curvature whose inner surface substantially conforms to the core, C. Eight (8) variegated fixed tongued equilateral triangular tiles of substantially spherical curvature whose inner concave surface substantially conforms to the core at fixed positions corresponding to the eight triangular regions on the core surface formed by the boundaries of the equitorial zones on the core surface, the tongues of the fixed tiles projecting into grooves of the movable tiles and thus keeping the movable tiles in conformation to the core yet movable in zonal grouping of eight.

2. A puzzle comprising: a three dimensional support; a plurality of closed loop tracks carried by said support and lying in mutually perpendicular intersecting planes; a plurality of equilateral, quadrilateral elements of at least two distinguishable types disposed in said tracks for movement therein, said elements occupying substantially the entire extent of said tracks; said elements being constrained for movment in the tracks in which they are disposed except at the track intersections at which the elements can be selectively transferred from one track to another, said elements each having a prescribed orientation which is not changed when the elements are transferred from one track to another.

* * * * *